United States Patent [19]

Weis et al.

[11] 4,133,372

[45] Jan. 9, 1979

[54] APPARATUS FOR BLASTING CASTINGS

[75] Inventors: Martin Weis, Ettlingen; Adolf Scholz, Karlsruhe, both of Germany

[73] Assignee: Badische Maschinenfabrik GmbH, Germany

[21] Appl. No.: 654,907

[22] Filed: Feb. 3, 1976

[30] Foreign Application Priority Data

Feb. 4, 1975 [DE] Fed. Rep. of Germany ..... 2504444

[51] Int. Cl.[2] ..... B22D 29/00

[52] U.S. Cl. ..... 164/404; 164/401; 51/418

[58] Field of Search ..... 164/48, 131, 253, 344, 164/404, 401, 158; 198/85, 102, 154, 156, 793, 794, 796, 797, 798, 652; 214/1 Q; 51/418

[56] References Cited

U.S. PATENT DOCUMENTS

| | | | |
|---|---|---|---|
| 3,030,678 | 4/1962 | Huston et al. | 164/48 |
| 3,991,685 | 11/1976 | Toby | 198/796 X |
| 4,001,976 | 1/1977 | MacMillan | 51/418 |

FOREIGN PATENT DOCUMENTS

| | | | |
|---|---|---|---|
| 588503 | 12/1959 | Canada | 214/1 Q |
| 778222 | 2/1968 | Canada | 198/156 |
| 318522 | 12/1969 | Sweden | 198/797 |

*Primary Examiner*—Richard B. Lazarus
*Attorney, Agent, or Firm*—Craig & Antonelli

[57] ABSTRACT

The apparatus comprises one or more blasting cabins through which are conveyed workpiece carriers in the form of grate bars secured only at one end to a conveyor chain. A shifting device transfers workpieces from a first to a second conveyor for a second pass through such cabin. A turning device turns the workpieces over during such transfer. Said device comprises a box which is rotated about a horizontal axis and chutes each workpiece onto the second conveyor.

16 Claims, 8 Drawing Figures

2
1
4
10
8
9
6
3
15
5

20
12
23
24
21
22
28
29
31
25
21
22
23

APPARATUS FOR BLASTING CASTINGS

The invention relates to an apparatus for blasting cast workpieces, in particular mould packs, said apparatus comprising a conveyor with horizontal workpiece carriers and one or more blasting cabins through which the workpiece carriers are conveyed. The term "mould packs" is used herein to refer to sand-castings with a plurality of individual cast workpieces, which are cast in a single mould.

In one type of such apparatus already known for the blasting of workpieces within a blasting cabin, the workpieces are carried by a flexible, endless horizontal belt of open wire mesh, which allows the blasting medium to have access to the workpieces from below so that the workpieces are impinged upon from all sides. It is apparent that for manufacturing reasons the wires of the belt must be relatively thin and therefore have an unsatisfactory length of useful life, even if the blasting action is relatively weak.

Another type of blasting apparatus which is also known comprises two chain runs guided horizontally and spaced apart in the direction of the cabin width, said chain runs having transverse rungs widely spaced for supporting the workpieces which are thus conveyed through the cleaning cabin. In this case there is in fact a better access for the blasting material from below, and because of the possibility of a more favourable dimensioning of the transverse rungs the useful life is longer than in the apparatus previously mentioned, but the utility of this conveyor is restricted to large workpieces, which, obviously, must extend over several rungs if they are to be securely supported.

Nevertheless the two types of apparatus, in the forms in which they are already known, suffer from the main disadvantage that, when dealing with workpieces having depressions situated at the upper side thereof, treatment of these is incomplete or altogether lacking because of the accumulation of the blasting medium in such depressions. In these types of apparatus such workpieces must have their position changed after a first working passage through the apparatus, so that in the course of a second passage through the apparatus the incompletely worked side of the workpiece assumes a more satisfactory position with respect to the access of the blasting medium. The interruptions in the working cycle which result from such operations are undesirable, particularly since they usually involve hand operations and require additional transport.

The present invention provides apparatus of the first-mentioned type so constructed as to enable an automatic simple and reliable loading and unloading of the workpieces and, in addition, to enable workpieces of all conceivable surface shapes to be processed equally well without recourse to manual operation.

According to the invention, there is provided apparatus for blasting cast workpieces, said apparatus comprising an endless chain conveyor with horizontal workpiece carriers and at least one blasting cabin through which the workpiece carriers are conveyed, the workpiece carriers being in the form of grate bars secured only at one end to the chain of the conveyor.

With this apparatus it is possible for the blasting medium to reach the workpiece from above and, depending upon the spacing between the grate bars, also to reach the workpieces from below so that these are worked upon in a uniform manner from all sides. The grate bars themselves can, whilst having an adequate strength, be so designed that they can be arranged at an adequate spacing to give access to the blasting medium coming from below. Because the grate bars are secured only at one end to the chain, and so have their gaps open towards one side, castings, which, as a result of the use of feed gates, and similar devices, have a complicated shape, which could cause them easily to become hooked between the grate bars, can, nevertheless, be removed at one side, which operation is not possible in the case of the previously known conveyors having only a perforated support surface.

For the purpose of removing, and, if necessary, also for depositing the workpieces or mould packs upon the conveyor, there is associated with the latter a shifting or thrusting device operating towards the free ends of the grate bars. If the grate bars, as will in any case be preferred, are so designed that they taper off towards their free ends, then the workpiece may be removed from the conveyor notwithstanding the fact that it may be of such complicated shape as to become hooked or wedged in the conveyor.

Because the grate bars are exposed to a high amount of wear resulting from the passage of the blasting medium, provision is also made for a set of grate bars to be connected to a holder, which itself is releasably secured to a pin of the conveyor chain. Any set of grate bars which have become worn may therefore quickly be released from the conveyor together with their holder and may be replaced by a new set of grate bars.

In order to balance the moment imposed upon the conveyor by the cantilever mounted grate bars, it is advantageous to provide the conveyor in the form of two spaced apart chains or runs and to support these on rails by means of rollers. For example, one rail may support the one chain at the lower side and the other rail may support the other chain at the lower side.

For the processing of castings which have depressions at the upper side thereof or else at both sides thereof, and to which therefore insufficient blast effect can be applied to the upper side during the first working passage, the apparatus may be provided with two conveyors and a turning station interposed between them. The workpiece processed upon the first conveyor is turned round at the turning station and is delivered onto the second conveyor so that the side which was originally uppermost now lies underneath and can be satisfactorily worked upon. In this operation also it is possible to effect a satisfactory unloading of the workpieces at the turning station and the delivery thereof onto the next conveyor by reason of the fact that the grate bars are arranged to project freely in one direction.

The two conveyors may be arranged to be parallel to each other and to run in opposite directions with the free ends of the grate bars mutually opposed, which results in a space saving system. In such a case the turning station advantageously consists of a boxlike container with two open sides, of which one is turned towards the one conveyor and the other towards the other conveyor, so that the turning or reversal is effected about a horizontal axis. In such a case the turning container can be arranged adjacent the discharge end of the one conveyor and in front of the head end of the other conveyor. By means of the above-mentioned shifting or pushing device the workpieces, or the mould pack, can be pushed over the free ends of the grate bars into the turning container and, after its reversal has been effected, transferred by means of a further pushing device from the turning container onto the second conveyor. It is in this respect appropriate to associate with the turning container a shifting or pushing device operating in the direction onto the second conveyor for thrusting the workpieces out onto this conveyor.

In this practical form it is possible for the turning or reversing shaft to be designed as a hollow shaft and to be penetrated by the shifting device.

According to a further feature of the invention the turning or reversing shaft of the container has a spacing distance from the base of the container which is different from the spacing from the opposing wall thereof so that the workpiece is elevated to a position above the second conveyor, in which case it may be pushed out onto the second conveyor through a chute.

Instead of adopting this construction, or additional thereto, it is possible to arrange that the wall of the container, which, after the reversal operation, forms the base of the container, is so inclined with respect to the receiving conveyor that the workpiece automatically slides onto the second conveyor.

Both of the conveyors may be guided through a single blasting cabin so that the capital outlay on the components of the system is kept small.

The invention will now be described with reference to various practical forms shown in the accompanying drawings in which.

Figure 1:
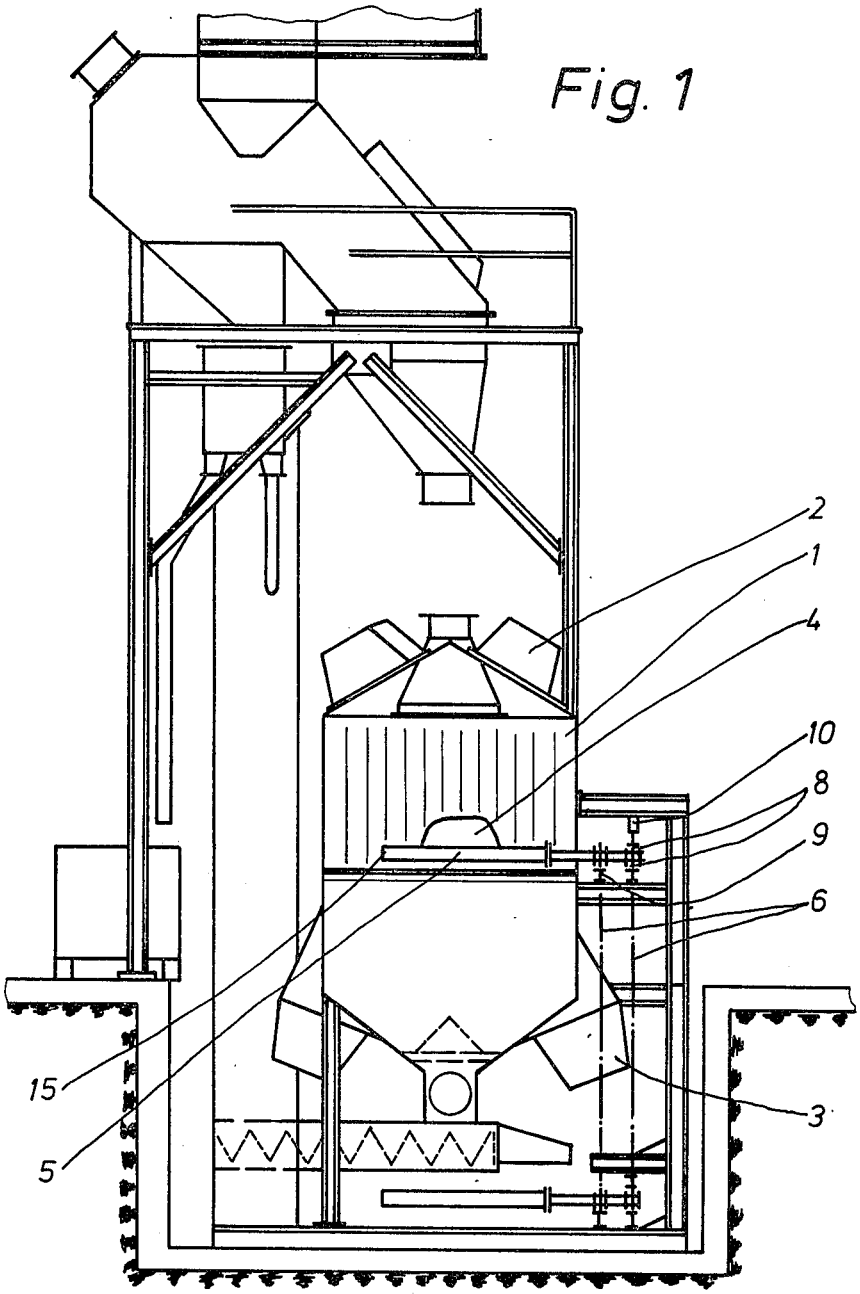
FIG. 1 is a cross-section through a blasting cabin of apparatus having a single belt conveyor.
Figure 2:
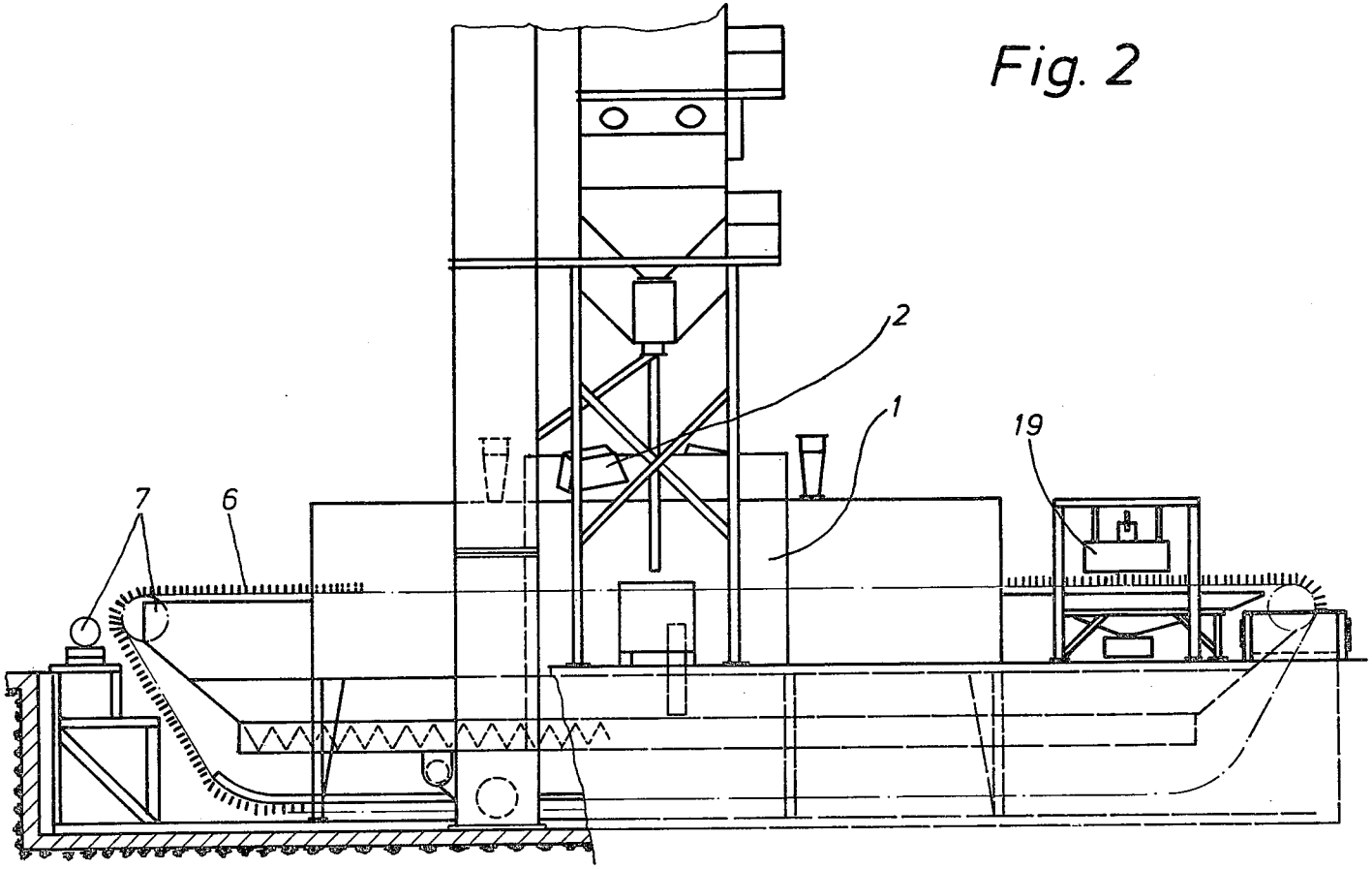
FIG. 2 is a side elevation of this apparatus partially broken away.
Figure 3:
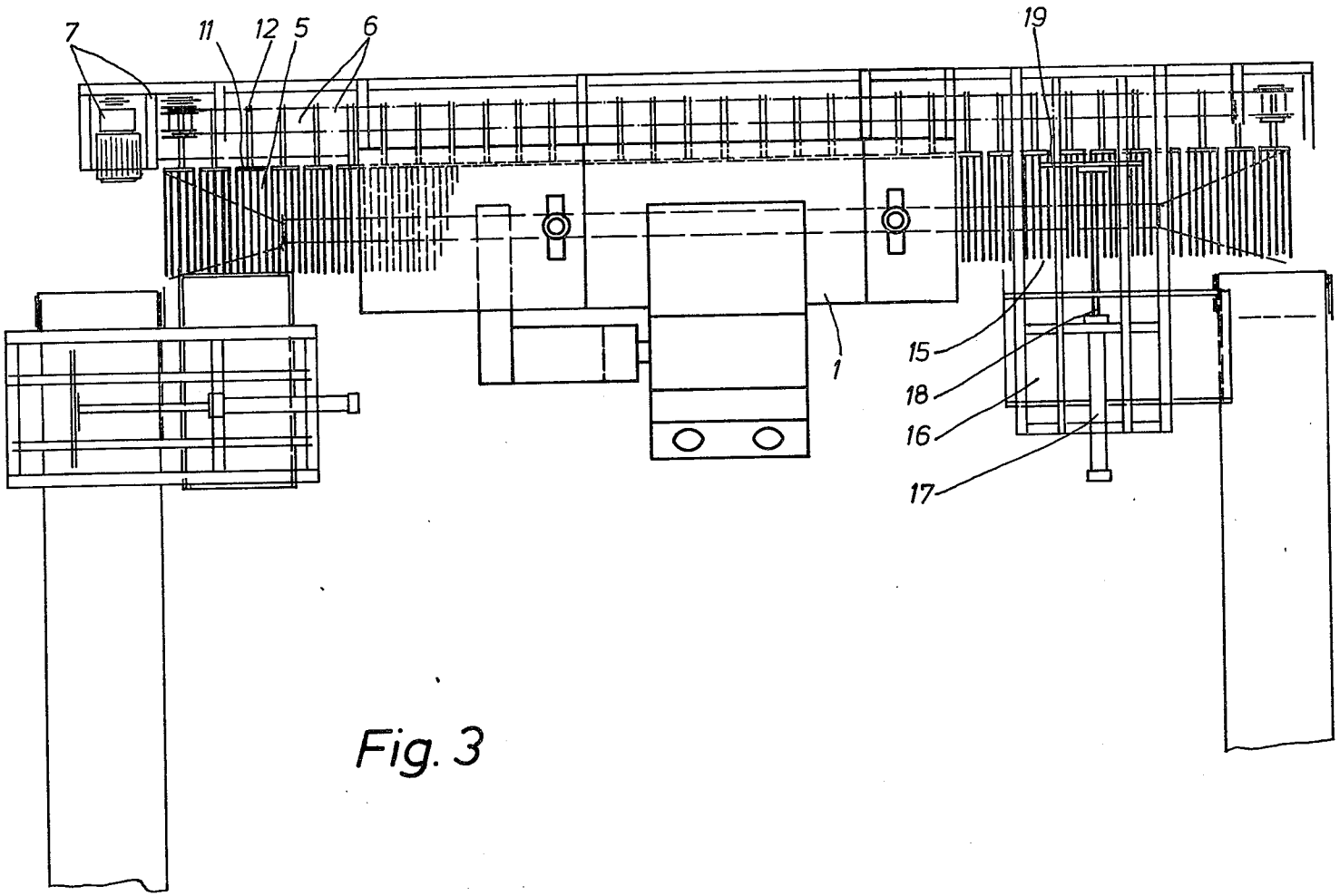
FIG. 3 is a plan view of this apparatus.
Figure 7:
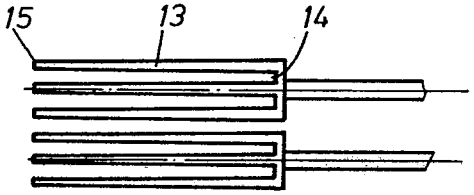
FIG. 7 is a detail view of the grate bars.

In FIGS. 1 to 3 there is shown a blasting cabin 1 with slinger wheels 2 at the upper side and slinger wheels 3 at the lower side. The workpieces 4 or mould packs are situated upon the grate bars 5, which are conveyed through the blasting cabin by an endless conveyor 6 with a drive 7. The two chain belts of the conveyor are provided with rollers 8 which at the lower side are supported upon the rail 9 and at the upper side upon the rail 10, thus bearing the weight of the workpieces. From FIG. 3 it is seen that five grate bars 5 are each connected to a holder 11, which itself is removably secured to a pin 12 of the chain, for example by being forced thereon. The grate bars 5, together with the holder 11, can be made integrally as a casting. In the practical form according to FIG. 7 there are three grate bars 13 combined with a holder 14, in which the grate bars taper off towards their free end 15. In FIG. 3 there is shown, associated with the conveyor 6, a shifting device generally designed by the reference numeral 16, in this case a drawing device, operating towards the free ends 15 of the grate bars. In the example here shown this device consists of a cylinder and piston unit 17 with a piston rod 18 and a driving plate 19 secured to it.

Figure 4:
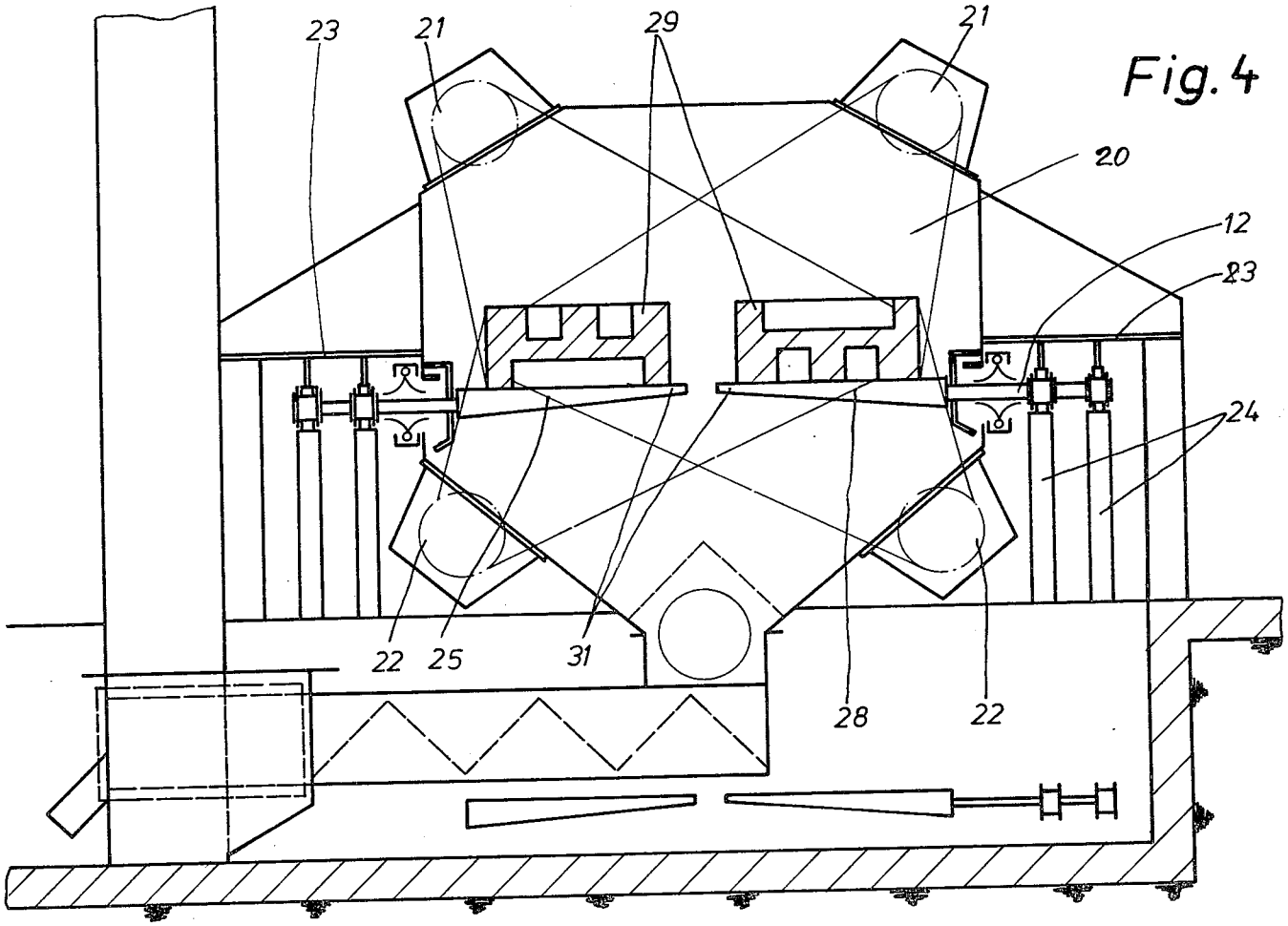
FIG. 4 is a cross-section through a blasting cabin of apparatus having a double belt conveyor.
Figure 5:
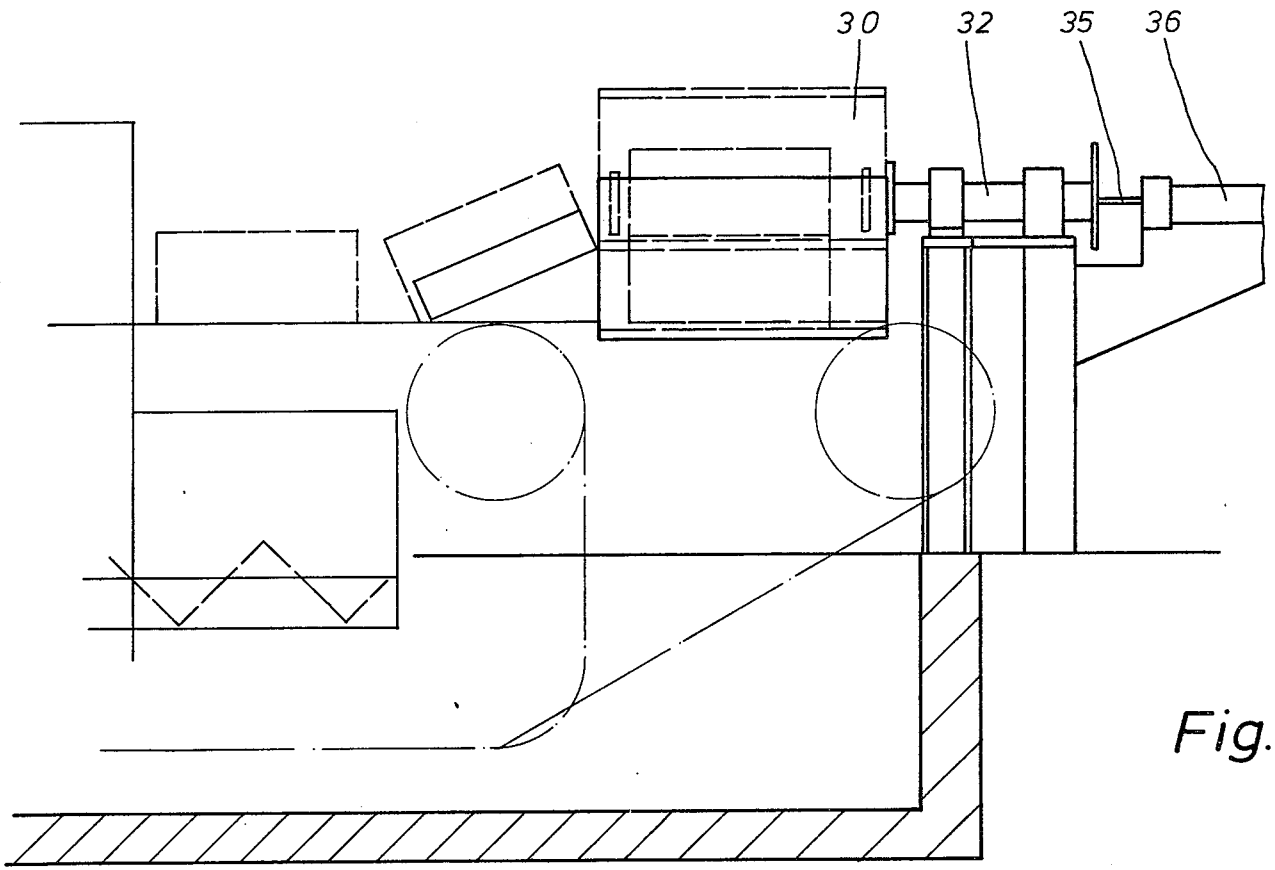
FIG. 5 is a side elevation of the apparatus according to FIG. 4 with a turning device.
Figure 6:
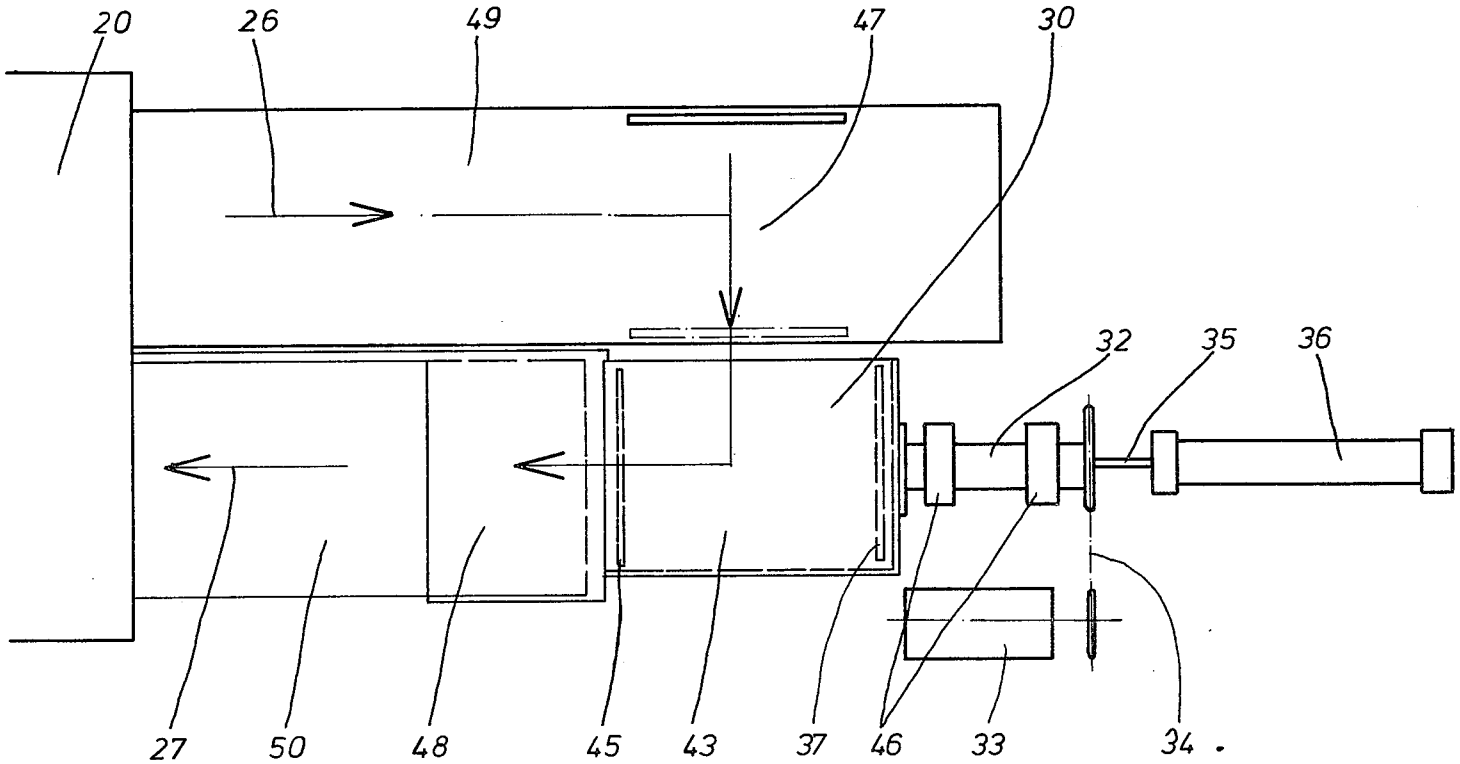
FIG. 6 is a plan view corresponding to FIGS. 4 and 5.

In the FIGS. 4 to 6 the blasting cabin 20 is fitted with upper slinger wheels 21 and lower slinger wheels 22. To the right hand and the left hand along the blasting cabin 1 in FIG. 4 there are provided housings 23 for the respective conveyors 24, (in the drawing only the right hand chain belt is referenced 24), these conveyors supporting the grate bars 25 having the direction of movement according to arrow 26 (FIG. 6), whilst the arrow 27 (FIG. 6) indicates the direction of movement of the oppositely situated grate bars 28, the free ends 31 of the respective sets of grate bars being situated facing each other. In the blasting cabin 20 there are situated on each conveyor a series of workpieces 29. Adjacent the discharge end of the one conveyor there is arranged a turning or reversing station 30 in front of the head end 48 of the other conveyor 50 (see FIG. 6).

Figure 8:
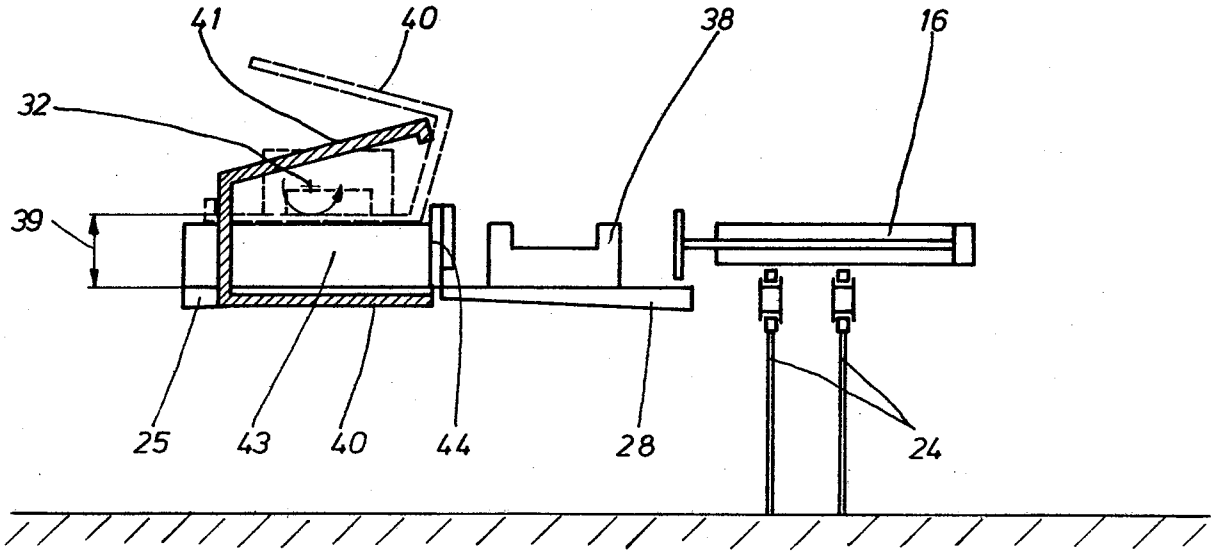
FIG. 8 is a longitudinal section through a turning device.

In FIGS. 6 and 8 the reference 43 generally designates a turning or reversing container provided at the discharge end 47 of a conveyor 49. The reversing container 43 has sides 44 and 45 which are open, the one open side 44 being turned towards the conveyor having grate bars 28 and the other open side 45 being turned towards the conveyor having the grate bars 25. The turning container 43 is supported by a hollow shaft 32, which is carried in bearings 46 and which is driven by a motor 33 through a chain transmission 34. Through the hollow shaft 32 penetrates the piston rod 35 of a cylinder 36 having a drive plate 37 for removing a workpiece from the turning container 43 onto the head end 48 of the second conveyor 50. For the purpose of effecting reliable transfer of the workpiece 38, the latter becomes situated, after the turning or reversal (position shown in dashed lines in FIG. 8), elevated by the amount 39 above the grate bars 28. This effect is achieved by an eccentric position of the turning or reversing shaft 32 such that the latter has a greater spacing from the base 40 of the turning container than from the opposite wall 41. After the turning operation taking place according to the direction of the arrow adjacent to 32 in FIG. 8, the turning container 43 together with the workpiece assume the position shown in dashed lines in FIG. 8, so that the workpiece can be transferred by means of a chute onto the second conveyor 50.

Instead of using the arrangement shown in FIG. 6 with the workpieces passing in opposite directions through a single blasting cabin 20, it is possible to adopt other arrangements having two separate blasting cabins, for example one in which the second conveyor is arranged with a second blasting cabin as an extension in the same alignment as the first conveyor or arranged at an angle thereto.

We claim:

1. A cast workpiece blasting apparatus comprising:

at least one cabin means for blasting cast workpieces with granular material, such as sand and the like, in a confined enclosure, a conveyor means including a plurality of workpiece carrier means for conveying cast workpieces of nonuniform dimensions through said blasting cabin means, each of said plurality of workpiece carrier means being fashioned with a plurality of approximately equally spaced tapered grate bars, said plurality of workpiece carrier means forming said conveyor means as a continuous, uninterrupted arrangement of approximately equally spaced tapered grate bars, means for securing only one end of each of said plurality of workpiece carrier means to the conveyor means, said securing means allowing said grate bars to be freely suspended so as to configure the conveyor means as a cantilever-type arrangement, and a shifting means, operatively associated with the conveyor means, including a means for engaging the cast workpieces on said grate bars and for applying a thrust to the cast workpieces so as to shift the cast workpieces towards a free end of the grate bars to load and unload the cast workpieces from the workpiece carrier means at the grate bars.

2. Apparatus for blasting cast workpieces of nonuniform dimensions, said apparatus comprising a conveyor with a plurality of workpiece carriers and at least one enclosed cabin means through which the workpiece carriers are conveyed for blasting the workpieces with granular material, the workpiece carriers being in the form of a plurality of approximately equally spaced tapered grate bars secured only at one end of the conveyor, and wherein the grate bars taper off along substantially their entire lengths towards their free ends.

3. Apparatus according to claim 1, wherein a holder means is provided for connecting said plurality of grate bars, said holder means being releasably secured to a pin of the conveyor means.

4. Apparatus according to claim 1, wherein the conveyor means comprises two chains arranged in spaced relation to each other, and wherein means are provided for guiding said two chains including rails upon which rollers of said two chains are guided.

5. Apparatus according to claim 4, wherein two rails are provided, one of the rails supports one of the chains at a lower side thereof and the other of the rails supports the other chain at the upper side thereof.

6. A cast workpiece blasting apparatus comprising:

at least one blasting cabin means, two endless chain conveyor means including horizontal workpiece carrier means for conveying cast workpieces through said blasting cabin means, said workpiece carrier means being fashioned as grate bars, means for securing only one end of said grate bars to the conveyor means, shifting means operatively associated with the conveyor means including a means for engaging the workpieces on said grate bars and for applying a thrust thereon so as to shift the workpieces towards a free end of the grate bars to load and unload the cast workpieces at the grate bars, and a turning station interposed between said conveyor means for turning the cast workpiece.

7. Apparatus according to claim 6, wherein both conveyor means pass through a single blasting cabin means.

8. Apparatus according to claim 6, wherein the two conveyor means are arranged in adjacent parallel relationship so as to run in opposite directions, and wherein the grate bars are arranged on each of said conveyors so that free ends thereof point towards each other.

9. Apparatus according to claim 6, wherein the turning station consists of a box-shaped container with two open sides, one of said open sides facing one of the conveyors and the other of said open sides facing the other conveyor, and wherein means are provided for turning said container about a horizontal axis.

10. Apparatus according to claim 9, wherein said container is situated adjacent a discharge end of said one conveyor and in front of a head end of said other conveyor.

11. Apparatus according to claim 10, wherein a shifting means is associated with said container including means for engaging the cast workpiece and shifting the same in a direction towards said other conveyor for shifting the cast workpieces onto said other conveyor.

12. Apparatus according to claim 11, wherein said means for turning the container includes a hollow shaft, and wherein said shifting means extends through said hollow shaft.

13. Apparatus according to claim 12, wherein said hollow shaft is spaced away from a base of said container by a greater distance than from an opposite wall of said container in such a manner that the cast workpiece, during the turning operation, is raised above said other conveyor.

14. Apparatus according to claim 13, wherein a wall of said container which, after the turning operation, forms the base of the container, is inclined with respect to the receiving conveyor such that the workpiece automatically slides onto that conveyor.

15. Apparatus according to claim 6, wherein the cast workpieces on one of the two conveyor means pass through the cabin means with one side up and the cast workpieces on the other of the two conveyor means pass through the cabin means with the opposite side up.

16. A cast workpiece blasting apparatus comprising:

at least one cabin means for blasting cast workpieces with granular material, such as sand and the like, in a confined enclosure, two conveyor means for conveying cast workpieces through the cabin means, said conveyor means including a plurality of carrier means for carrying workpieces, each of said plurality of workpiece carrier means having a plurality of grate bars, one of said two conveyor means conveying cast workpieces in one direction through the cabin means and the other of said two conveyor means conveying cast workpieces in the opposite direction through the cabin means, means for securing only one end of each of said plurality of carrier means to the conveyor means, shifting means, operatively associated with the conveyor means, for engaging the cast workpieces on the grate bars and for applying a thrust to the cast workpieces so as to shift the cast workpieces towards a free end of the grate bars to load and unload the cast workpieces from the conveyor means, and a turning station interposed between said two conveyor means for turning the cast workpieces upside-down and for transferring the cast workpieces from one of the two conveyor means to the other of the two conveyor means for reconveying through the cabin means.

whereby the cast workpieces on the one of the two conveyor means pass through the cabin means with one side up and the cast workpieces on the other of the two conveyor means pass through the cabin means with the opposite side up.

* * * * *